United States Patent [19]

Artwick et al.

[11] Patent Number: 4,779,518

[45] Date of Patent: Oct. 25, 1988

[54] WHOLE HOUSE VENTILATING METHOD, SYSTEM AND APPARTUS

[75] Inventors: Kert E. Artwick, Roswell; Steven A. Leonard, Marietta, both of Ga.

[73] Assignee: Leslie-Locke, Inc., Atlanta, Ga.

[21] Appl. No.: 456,304

[22] Filed: Jan. 6, 1983

[51] Int. Cl.[4] ..... F24F 13/18; F24F 7/013

[52] U.S. Cl. ..... 98/116; 16/360; 16/361; 16/380; 98/42.09

[58] Field of Search ..... 98/43 R, 116, 119; 137/527, 852; 16/262, 267, 270, 271, 360, 361, 380

[56] References Cited

U.S. PATENT DOCUMENTS

| | | | |
|---|---|---|---|
| 3,263,906 | 8/1966 | Ward | 98/116 X |
| 3,334,569 | 8/1967 | Lambie | 98/116 |
| 3,482,503 | 12/1969 | Jenn | 98/33 |
| 4,151,789 | 5/1979 | Grobard | 98/119 |
| 4,196,745 | 4/1980 | Schützer | 137/527 X |
| 4,335,646 | 6/1982 | Jacquet et al. | 98/2 |
| 4,385,550 | 5/1983 | Steiner et al. | 98/43 R |
| 4,406,216 | 9/1983 | Hott et al. | 98/116 |

*Primary Examiner*—Harold Joyce
*Attorney, Agent, or Firm*—John E. Benoit

[57] ABSTRACT

A method of and apparatus for controlling air flow through the medium of a circular frame structure upon which is pivotally mounted a plurality of shutters, the frame being adapted to be secured to a ceiling of a room or space in which ceiling an opening has been cut to accommodate air flow and movement of the pivotally mounted shutters. The circular frame structure and shutter assemblage is substantially flush with the plane of the ceiling and a housing and ventilating fan is disposed in an attic or space above the opening in the ceiling. The ventilating fan above the shutters is rotated in a direction to draw air from the room upwardly into the attic space for dissipation through conventional air vents located in the roof or wall region of an attic space. The circular support frame structure and the shutters are molded of resinous plastic material and the shutters are pivoted by pivot pins integral with the shutters which are pivotally mounted in the circular portion of the frame structure and in a central support means or region of the frame structure.

20 Claims, 7 Drawing Sheets

WHOLE HOUSE VENTILATING METHOD, SYSTEM AND APPARTUS

TECHNICAL FIELD

This invention relates to a method, system and apparatus for ventilating a whole house through the medium of a ventilating fan disposed above an opening in the ceiling below an attic space, the latter having conventional outside vents, The method, system and apparatus embody an assemblage of movable shutters or vanes arranged in an opening in the ceiling which are normally closed when the circulating fan is not in operation and which are automatically opened by reduced air pressure above the shutters set up by rotation of the ventilating fan in a direction for exhausting air from the room or whole house area and delivering the air through the conventional vent openings in the walls or roof of the attic space.

DISCLOSURE OF THE INVENTION

The present invention relates to a method, system and apparatus for ventilating a whole house through the medium of a ventilating fan disposed above an opening in the ceiling and which is enclosed in a housing or shroud in the attic space which has conventional outside vents in the walls or roof structure of the attic. Disposed in the opening in the ceiling is an assemblage of movable shutters or vanes below the fan housing or shroud, the shutters being actuated to open positions by reduced air pressure below the fan resulting from operation of the circulating fan to vent the whole house or the room beneath the ceiling by an air stream which automatically opens the shutters during operation of the fan for exhausting air from the whole house or space below the ceiling and the air exhausted from the space or whole house being driven through the conventional vent openings provided in the walls or roof structure when the fan is in operation.

The shutter arrangement for the whole house ventilating system may be readily installed in an opening in the ceiling below an attic space in a house already constructed or installed in a new house construction. The shroud or housing of the circulating fan may be readily mounted upon a subframe supported by ceiling joists, the assembly of movable shutters being arranged in the ceiling opening whereby the shutters when in closed position are in substantially the plane of the ceiling. The fan housing, the circulating fan and the motor operating the fan are supported by the supplemental frame, and when the shutters are in open position the air is exhausted through the fan housing into the attic and the air dissipated from the attic through conventional vents in the attic walls or roof construction. As the assembly of movable shutters and the circulating fan are adjacent the ceiling structure below an attic space, the circulating fan and the movable shutters are not subjected to adverse weather conditions.

An important feature of the invention is the provision of a shutter construction for controlling air flow, the shutter construction including a circular or annular support frame structure having a central support means and wherein a plurality of shutters are pivotally supported upon the circular region of the support frame and the central support means, the structure being of such character that the frame structure and the shutters may be readily mounted in an opening in a ceiling construction of a room or space.

BRIEF DESCRIPTION OF THE DRAWINGS

The details of the invention will be described in connection with the accompanying drawings in which.

BEST MODE FOR CARRYING OUT THE INVENTION

The method, system and apparatus of the invention involve a ventilating apparatus for venting a house through a movable shutter arrangement in an opening in a ceiling of a room or space with a ventilated attic or space above the room and an air moving means above the shutter arrangement. The apparatus is inclusive of a frame structure supporting a plurality of movable shutters or vanes which, when closed, are substantially in the plane of the ceiling of the room, and which shutters or vanes are opened by an air stream set up by a fan disposed in a housing or shroud in the attic space above the shutters. The fan is rotated in a direction to provide reduced air pressure above the shutters or vanes whereby the pressure in the room or house being ventilated causes the shutters or vanes to be swung or moved upwardly to an open position and the air from the room or house is delivered through the attic or attic space to the outside atmosphere through conventional vents in the walls or roof structure of the attic.

Figure 1:
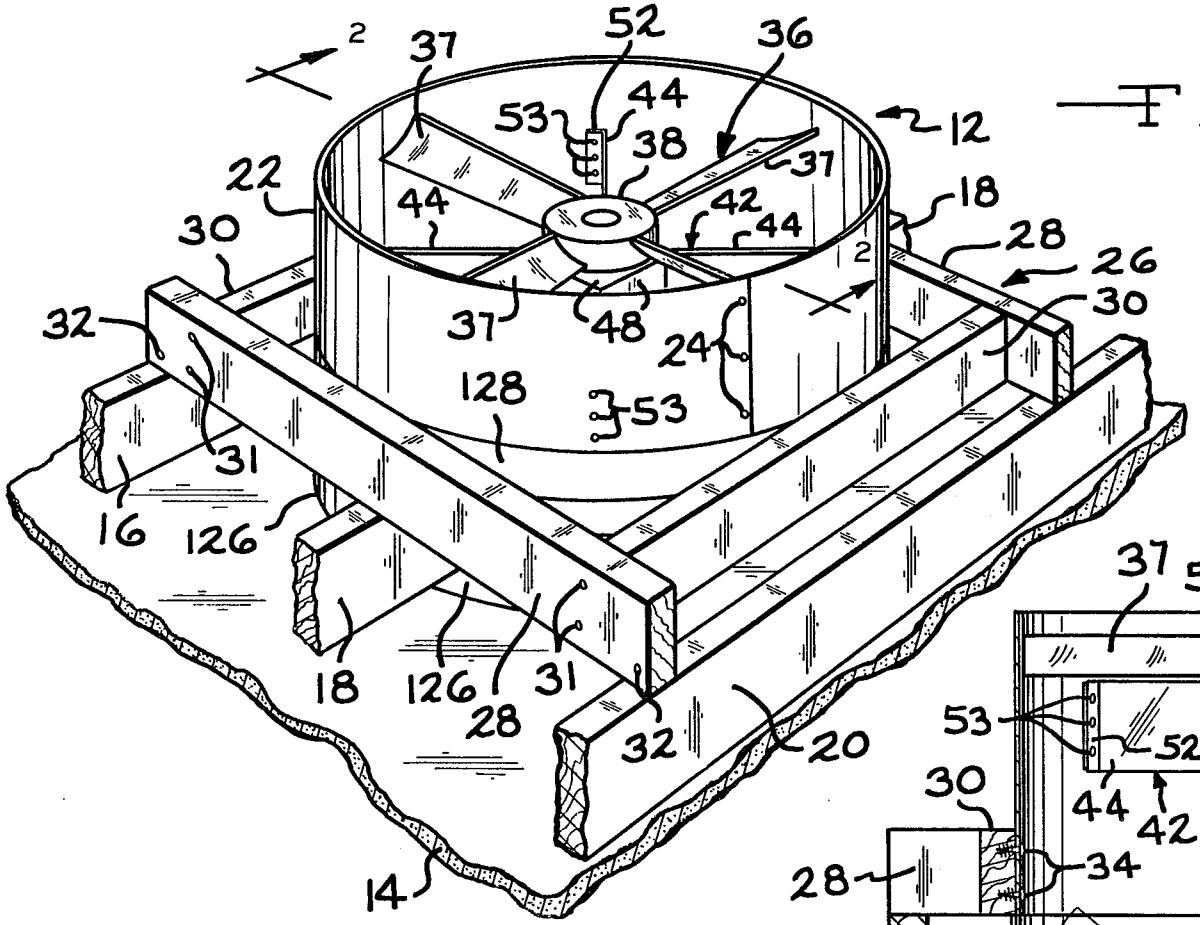
FIG. 1 is a perspective fragmentary view of a joist and ceiling construction illustrating the whole house ventilating fan and shutter construction mounted on the joists
Figure 2:
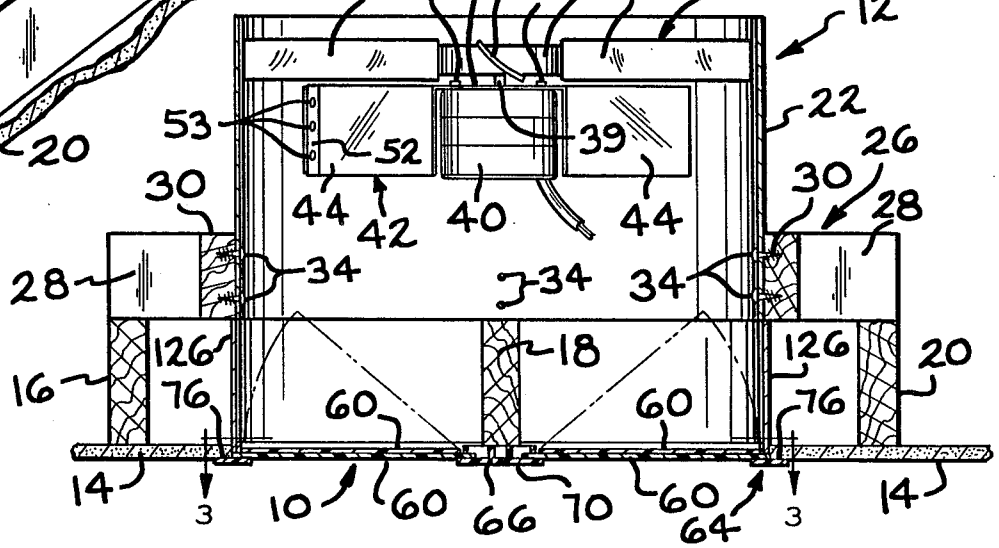
FIG. 2 is a sectional view taken substantially on the line 2—2 of FIG. 1.

Referring initially to FIGS. 1 and 2, there is illustrated a ventilating fan and one form of frame and shutter arrangement mounted in an opening in the ceiling of a room above which is a ventilated attic space. The shutter arrangement or assembly 10 comprises a plurality of movable vanes or shutters pivotally mounted by a support frame in an opening in the ceiling 14 of the space or house being ventilated and the ventilating fan and housing or shroud construction 12 extends into the attic or attic space above the ceiling.

A circular opening is cut in the ceiling 14 to accommodate the shutter arrangement or assembly 10. Disposed above the ceiling construction 14 are conventional joists, three of which are indicated at 16, 18 and 20. The fan housing or shroud 22 is of circular cylindrical shape as particularly shown in FIGURE 1. The shroud or housing 22 preferably comprises a strip of comparatively thin metal formed into an annulus with the ends of the strip overlapping and secured together by rivets 24. The housing or shroud may be cast or molded of suitable material to a circular configuration.

A subframe or frame structure 26 is provided for supporting the fan and housing assembly from the joists. The subframe 26 comprises two strips 28 of wood extending transversely across the joists. Disposed between the strips 28 are wood strips 30, the strips 28 being secured to strips 30 by means of nails 31. The subframe 26 is supported by engagement of the strips 28 with the joists 16, 18 and 20. The strips 28 and 30, when assembled, are of a dimension to receive the housing or shroud 22 as shown in FIG. 2.

The strips 28 are nailed to the joists 16 and 18 by toed nails 32. As shown in FIG. 2 the fan housing or shroud 22 is secured to the strips 28 and 30 by means of screws 34. The central axis of the fan housing or shroud 22 passes through the center of the joist 18. The fan 36 comprises a plurality of fan blades 37 which are mounted upon a central hub member 38, the hub member 38 being mounted upon a shaft 39 of an electrically energizable motor 40. The fan 36 is driven by the motor 40.

A motor supporting frame or bracket means 42 is of one piece construction preferably of metal having four outwardly extending arm portions 44, two of which are shown in FIGURE 2, which are integrally connected together by a central portion 48. The housing of the motor 40 is secured to the central portion 48 of member 42 by means of bolts 50. The four arm portions 44 project to the interior surface of the housing or shroud 22. Each of the end regions of the projections 44 is fashioned with a flange 52 which is secured to the support or shroud 22 by rivets 53. Through this means the motor is rigidly supported from the housing or shroud 22.

The fan blades 37 are of a length slightly less than the inner diameter of the housing or shroud 22 as shown in FIG. 2 so as to have a minimum running clearance within the housing or shroud 22. The electrically actuated motor 40 may be controlled by a switch means (not shown) mounted within the room or space defined below the ceiling 14 for convenient operation of the motor.

The fan blades, as shown in FIG. 2, are contoured so that when the motor rotates the fan in a counterclockwise direction the fan blades move air upwardly through the housing or shroud 22 and exhaust the air into the attic where the air flows outwardly through the attic vents.

The shutter assembly 10 is inclusive of a plurality of generally circular sector-shaped shutters or vanes 60. The vanes or shutters are particularly shown in FIGS. 2 and 3. The shutters are illustrated in closed position in FIGS. 2 and 3 in which position the shutters prevent flow of air from the attic to the room or house being ventilated.

The shutters or vanes 60 are supported by and journaled for movement relative to a circular or annular frame or member 64 and a central support means or member 70. It should be noted from FIG. 2 that when the shutters 60 are in a closed position, the lower surfaces of the shutters are substantially in the plane of the lower surface of the ceiling 14. The circular or annular frame 64 is fashioned of molded resinous plastic material such as high impact polystyrene.

Extending transversely at the mid region of the frame is a bar or member 66 of resinous material molded integrally with the annular frame 64. Integrally molded with the member or bar 66 and the circular frame 64 at its central region is the support member 70 supporting the inner ends of the vanes or shutters 60 in a manner hereinafter described.

Figure 4:
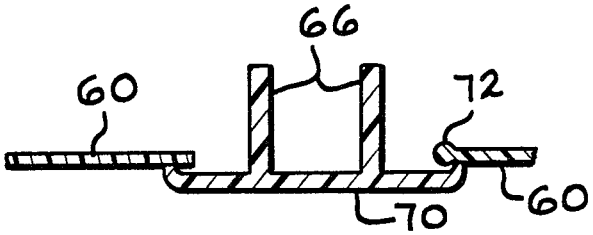
FIG. 4 is an enlarged fragmentary sectional view taken substantially on the line 4—4 of FIG. 3.
Figure 5:
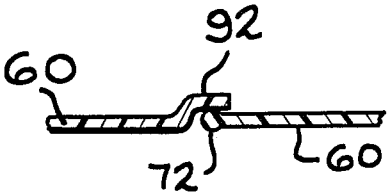
FIG. 5 is an enlarged fragmentary sectional view taken substantially on the line 5—5 of FIG. 3.
Figure 6:
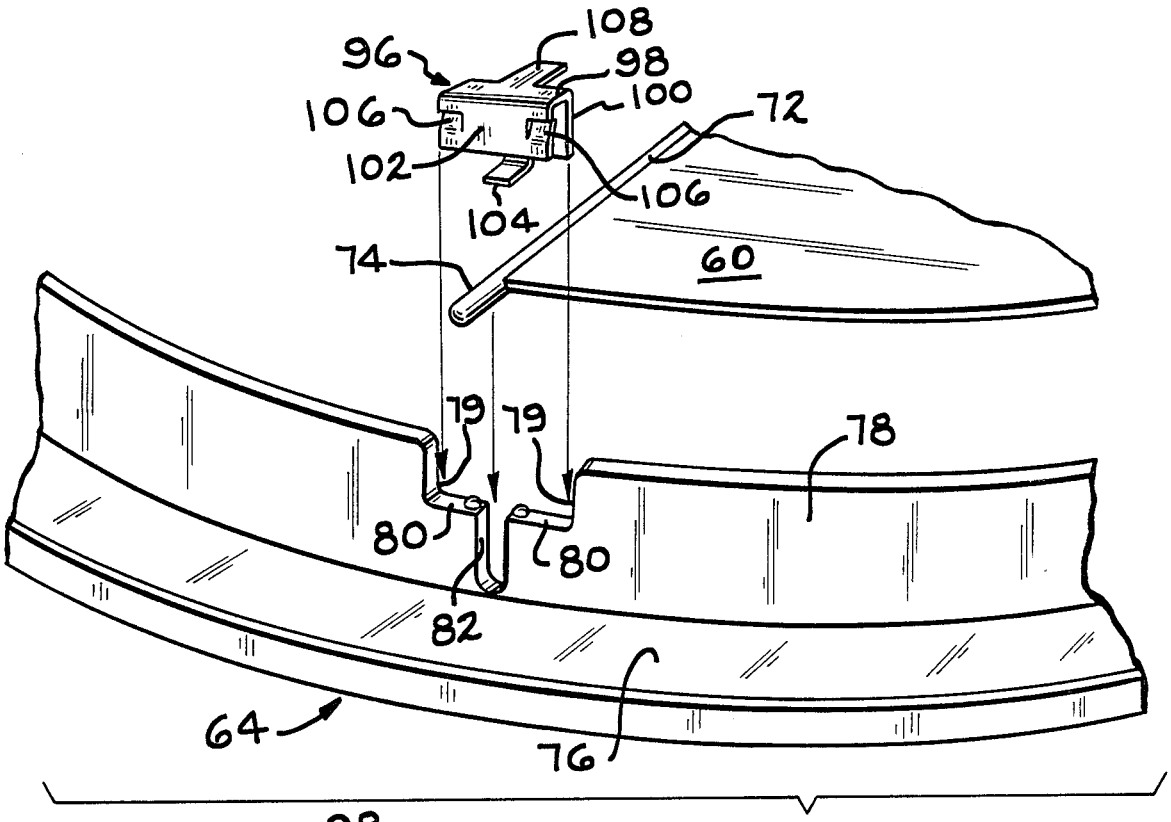
FIG. 6 is an enlarged expanded fragmentary perspective view illustrating the method of assembly and mounting of the outer end of a shutter in an annular or circular shutter supporting frame of molded resinous plastic and the retaining means for the shutter.

Each of the sector-shaped shutters or vanes 60 is formed at one radial edge with a ridge portion 72 of circular cross section as shown in FIGS. 4 and 5, the circular cross section of the member 72 extending beyond the outer circular edge of a shutter 60 forming a cylindrical pintle, pin or shaft 74 as shown in FIG. 6 which is also of plastic material as each of the shutters 60 is of molded resinous material such as high impact polystyrene.

Figure 3:
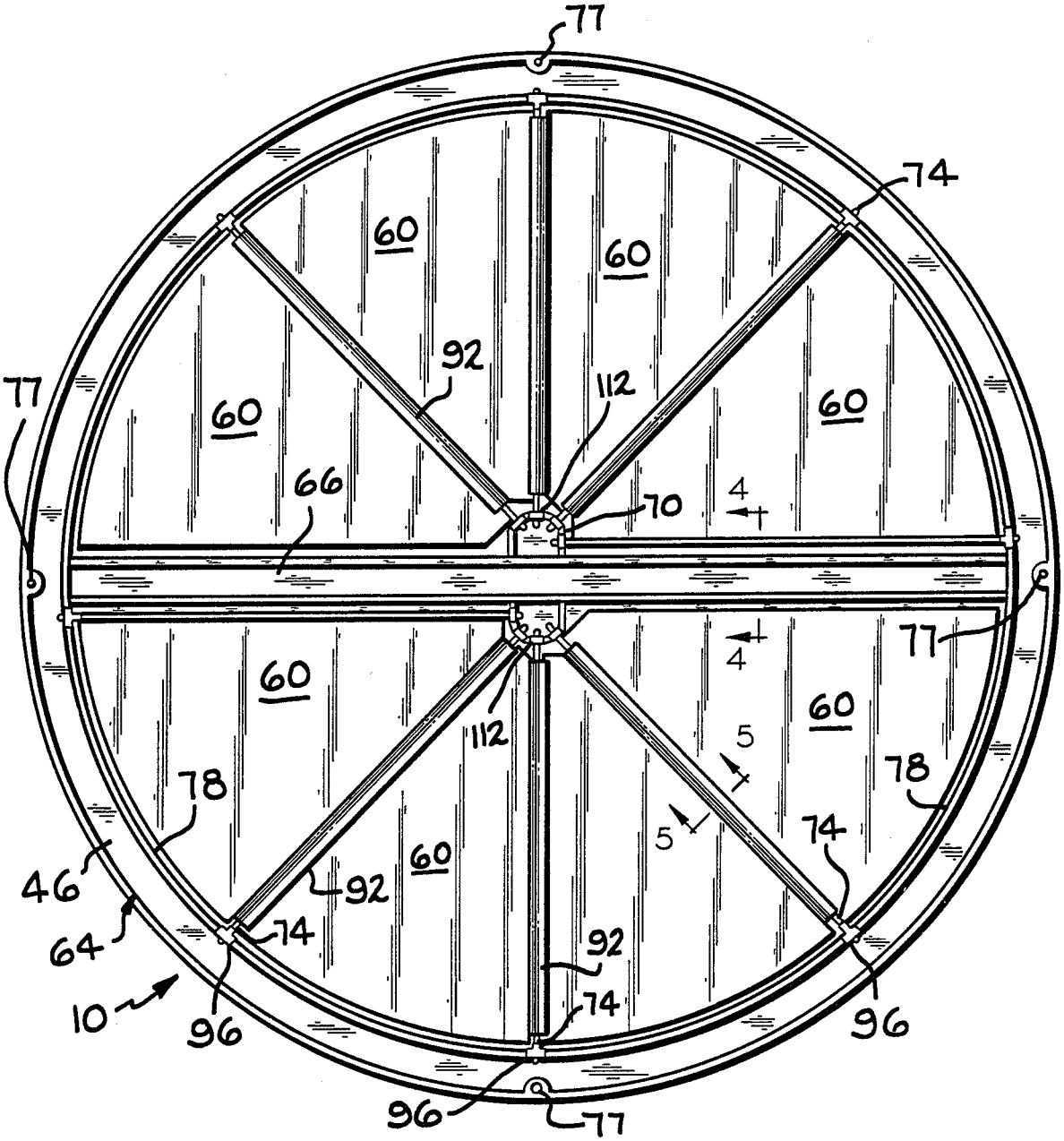
FIG. 3 is a plan view of the shutter assembly construction, the view being taken on the line 3—3 of FIG. 2.
Figure 8:
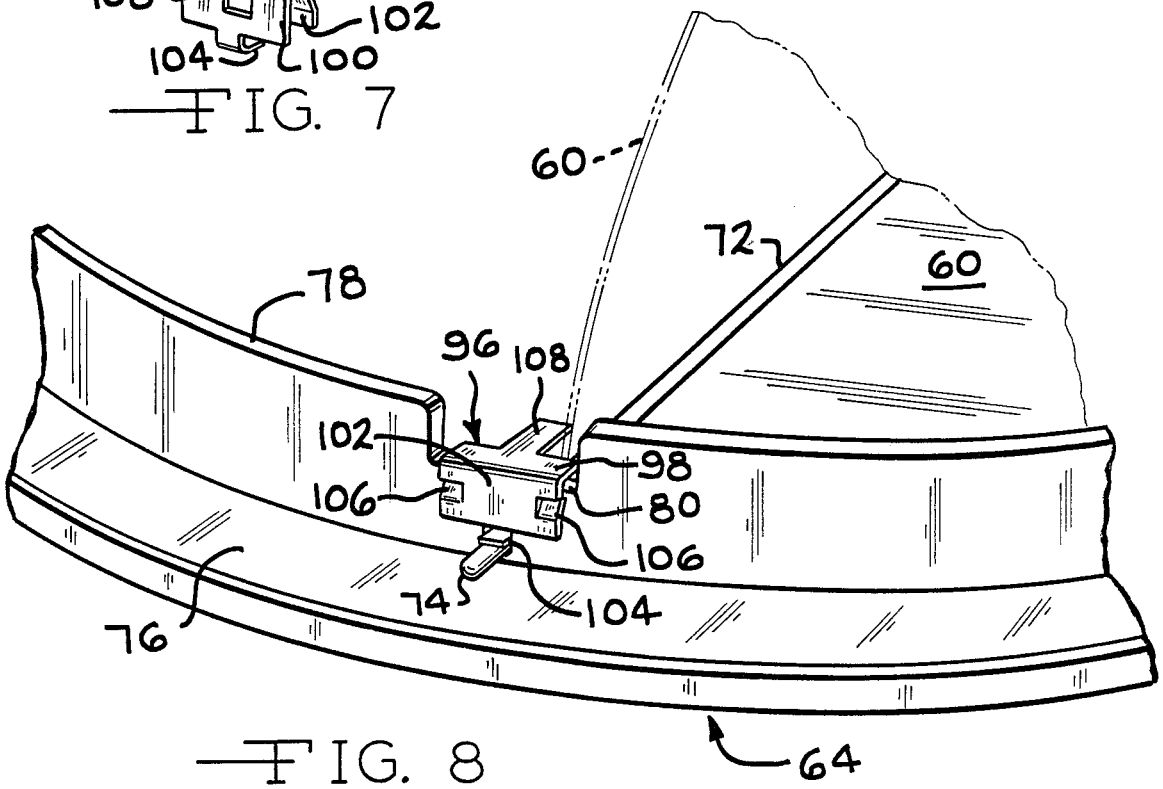
FIG. 8 is an enlarged perspective view showing a shutter and retainer or clip assembled with the central support means or section of the annular shutter support frame.

The annular or circular frame member 64 is fashioned with a circular flange 76 which is integrally joined with a circular or cylindrical wall or band 78, the band 78 being concentric with the flange 76 as shown in FIGS. 3, 6 and 8. The circular band 78 adjacent each of the pintles 74 is provided with a slot 79 terminating in flat base portions 80 as shown in FIG. 6. The band 78 is provided with comparatively narrow slots 82 which in assembly receive the pintles 74 of the shutters or vanes 60.

Figure 9:
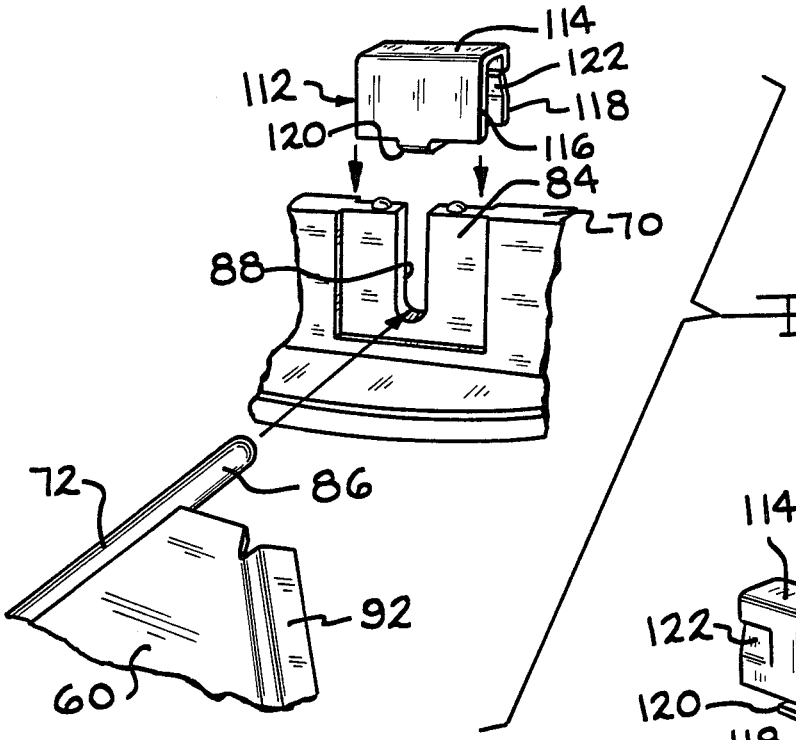
FIG. 9 is a fragmentary expanded perspective view illustrating the method of assembling the inner end of a shutter with a resinous plastic central support member and inner retainer.
Figure 11:
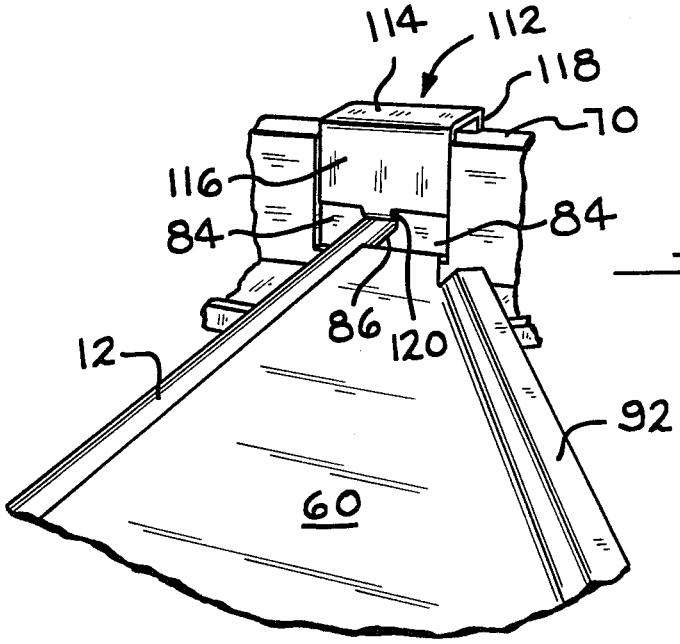
FIG. 11 is a fragmentary perspective view showing the assembly of a shutter with the central support member and the inner shutter retainer or clip.

The molded resinous central support means 70 has portions 84 of reduced thickness, shown in FIG. 9, adjacent the pintle, pin, or shaft portion 86 extending inwardly from each of the shutters 60. The reduced portions 84 of the central member 70 molded integrally with the bar 66 and the circular frame 64 have slots 88 for receiving the pintles, pins or shaft portions 86 of the shutters or vanes 60 as shown in FIGURES 9 and 11.

Thus the outer pins or pintles 74 of the shutters 60 are received in slots 82 in the circular band 78, and the inner extending pins or pintles 86 of the shutters 60 are received in slots 88 in the central support portion 70. In this manner each of the shutters 60 through the engagement of its pintles 74 and 86 in the respective slots 82 and 88 provides a pivotal mounting for each of the shutters in the circular frame or support 64 and the central support means 70.

The opposite radial edge region of each of the shutters 60 is provided with a raised edge extension 92 which overlies the ridge or shaft portion 72 of the adjacent shutter or vane 60 in the manner shown in FIG. 5 thus providing an overlapping of edge regions of the circular sector-shaped shutters or vanes when in closed positions so as to prevent air movement through the shutter assemblage from the attic into the living space or room beneath the attic.

As shown in FIG. 2, the lower planar surface of the ceiling 14 is engaged by the outwardly extending flange 76 of the circular shutter supporting member or frame 64. The cross member 66 integral with the circular support frame 64 is in alignment with the center joist 18 shown in FIG. 2. The peripheral band 76 of the circular support frame 64 is provided with openings 77 adapted to receive securing screws (not shown) for securing the frame 64 to the plaster ceiling 14.

The securing screws extending through the openings 77 in alignment with the horizontal member or bar 66 of the support frame are threaded into the central joist 18, and the two screws entering the other two openings 77 in the band 76 are threaded into threaded clips or nuts (not shown) disposed above the plaster ceiling 14 providing additional support for the support frame.

The screws accommodated in the openings 77 secure the center support frame 64 and the shutter assembly to the ceiling 14 in the position shown in FIG. 2. The pintles 74 of the circular ridge 72 on each of the shutters or vanes 60 rest in slots 72 in the band portion 78 of the circular support frame 76, and the inner extending pintles 86 of the raised or shaft portions 72 of each of the shutters or vanes 60 rest in grooves 88 in the central support portion 70.

Thus the pintles on each of the shutters or vanes 60 disposed in the slots 82 and 88 are rotatable about the axes of the pintles of each of the shutters or vanes so that each of the shutters readily opens under the reduced air pressure provided by the fan when in operation.

The apparatus or arrangement includes means for retaining the pintles 74 and 86 in the notches, grooves or slots 82 and 88 in the support members 64 and 70 without impairing swinging movement during open and closing movements of the shutters or vanes. The means for retaining the pintles 74 of the shutters or vanes in the slots 82 include a clip, retaining means or fastener 96 for each of the pintles, one form of retaining means being shown in FIGS. 3, 6, 7 and 8.

Figure 7:
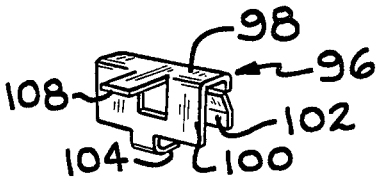
FIG. 7 is an isometric view of the reverse side of the clip shown in FIG. 6.

Thus there are eight clips for retaining the eight pintles 74 of the eight shutters or vanes in the slots 82 of the support frame 64. Each of the clips or retaining means 96 is formed of sheet metal. Each of the retainers 96 is of generally U-shaped configuration as shown in FIGS. 6, 7 and 8 having a central portion 98 and side walls 100 and 102.

The space between the side walls 100 and 102 is of a dimension to be snugly received over the adjacent portions of the band portion 78 of the frame or support 64. The lower central region of the wall 100 is provided with a projection, pad or tab portion 104 which extends substantially at right angles to the wall portion 100 as particularly shown in FIGS. 6 and 8.

When the clip or retaining means 96 is assembled with the circular frame member 64 as illustrated in FIG. 8, the flat or planar surface of the pad or tab portion 104 is adjacent the pintle 74 so that during swinging movements of the shutter the metal pad will not cause any wearing or abrasion o the pintle 74 which is of resinous plastic material.

The outer wall 102 of each retainer 96 is fashioned with inwardly extending projections or lug portions 106 which are bent inwardly as in FIGS. 6 and 8 so that when a clip or retainer 96 is assembled in position on the band portion 78 of the circular frame 64, the edge regions of the projections or lugs 106 snugly or frictionally engage the band 78 so as to retain the clip or retainer 96 on the band 78 of the circular support member 64.

Each of the base portions 98 of the retainers 96 is fashioned with a tab, stop means or member 108 which is engaged by a shutter 60 when the same is moved by the air stream to an open position, the edge region of the shutter 60 engaging the stop means 108 when the shutter is open to the position shown in broken lines at 60' in FIG. 8.

This stop means limits the opening movement of each of the shutters 60 so that when the ventilating fan motor is deenergized all of the shutters 60 will return by the force of gravity into their proper closed positions where one shutter overlaps another shutter as illustrated in FIGS. 3, 4 and 5. The retaining means, retainers or clips 96 maintain the pintles 74 in the recesses 82 in the band 78 in all positions of the shutters.

It has been previously pointed out that the inner pins, pintles or shaft portions 86 of the molded plastic shutters 60 extend into the recesses 88 in the central support portion 70 of the frame 64. The pins, pintles or shaft portions 86 are retained in the recesses 88 by means of metal retainers, clips or fasteners 112 shown in FIGS. 3, 9, 10 and 11.

Figure 10:
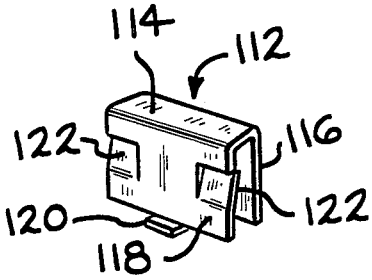
FIG. 10 is an isometric view of the reverse side of the retainer or clip shown in FIG. 9.

The retaining means, clips or fasteners 112 are similar to the clips, retainers or fasteners 96. Each of the retainers, clips or fasteners 112 is of generally U-shaped configuration comprising a base portion 114 andside walls 116 and 118. The lower central edge region of the side wall 116 is provided with a tab or projection 120 integral with and extending inwardly of the wall 116 and overlapping the edge of the wall 118 as shown in FIG. 10.

When a retaining means, clip or fastener 112 is assembled with the central member portion 70 in the manner shown in FIG. 11 the flat or planar surface of the tab or projection 120 is above the pintle 86 so that the metal of the clip or retaining means 112 will not abrade or bind against the plastic pintle 86.

The wall 118 of each of the retaining means, clips or fasteners 112 is formed with inwardly extending lugs or projections 122. When the retaining means, clips or fasteners 112 are assembled with the central support portion 70 of the frame 64 in the manner illustrated in FIG. 11, the sharp edges of the inwardly extending projections 122 of each of the clips snugly engages the portions 84 of the central support member portion 70 so that the clips or retainers 112 are prevented from dislodgment after they are assembled to hold the pintles 86 in the recesses or slots in the manner shown in FIG. 11.

In such assembled positions the flat surfaces of the metal tabs or projections 120 are adjacent the cylindrical plastic pintles or pins 86 molded with the shutters 60 so that the pintles will not be abraded by the metal retainers by reason of pivotal movement of the shutters.

The sharp edges of the lugs 106 of the retainers 96 and the sharp edges of the lugs 122 of the retainers 112 tend to bite into the resinous plastic material of the band 78 and the portions 84 of the central portion 70 of the circular frame structure 64 so that the retainers will be frictionally secured to the band 78 and the portions 84 of the support portion 70 of the frame thereby retaining the pintles of the shutters in the slots without impairing free movement of the shutters to open and closed positions.

Referring to FIGS. 1 and 2 it will be noted that the lower edge of the shroud or housing 22 terminates adjacent the lower edges of the frame members 28 and 30 of the subframe or supplemental frame 26. Disposed between the flange 76 of the circular support frame 64 and the lower terminus of the shroud or housing 22 is an open space equal to the height of the joists 16, 18 and 20.

Enclosing this space is a housing extension comprising strips 126 of metal, such as aluminum, which form a continuation of the cylindrical housing or shroud 22, the strips engaging the upper surface of the flange portion 76 of the circular frame 64.

These strips 126 forming an enclosed extension of the housing or shroud 22 are of the contour of the circular housing or shroud 22 and are secured to the center joist 18 so that when the shutters 60 are in open position the upwardly directed air stream provided by the rotation of the ventilator fan 36 will cause the shutters to be opened to ventilate the space or house area below the ceiling 14.

The upper portion of the metal strips 126 may be overlapped if desired with the lower edge region of the shroud or housing 22 and the junctures of the strips 126 with the housing or shroud 22 are covered with adhesive or duct tape 128 shown in FIG. 1 so that there is no leakage of air at the juncture of the shroud or housing 22 with the strips 126.

When the circulating fan 36 is not operating, the circular sector-shaped shutters 60 are in closed position and completely obstruct movement of air between the attic space and the whole house or room area below the ceiling 14. The switch for controlling the electrically operated motor 40 for rotating the fan 36 may be disposed in any desired position for convenience in operation anywhere in the house.

It is important to the most efficient operation of the ventilating system to have the outside air vents of the attic of a size to accommodate the exhaustion of air from the attic space sufficient to provide an air stream effective to open the shutters 60 to their full open or near open position.

For an average circulating fan of a diameter of about twenty inches the vent openings for the attic space should total about seven hundred twenty square inches of free ventilating area to assure movement of the air stream through the fan housing or shroud 22 to effectively open the shutters 60 of the shutter assembly.

If a larger diameter circulating fan is utilized the area of the attic air exhaust vents should be proportionately increased. Through the use of the stop means 108 on the clips or retainers 96 the opening movement of the shutters 60 to near full open position is attained without the shutters reaching a position where they would not return by gravity to their proper overlapping relation in closed position.

Through the provision of shutters which, in closed position, are substantially in the plane of the ceiling 14, the closed shutters do not present an unsightly appearance in the room or living space of a building or house, and the shutters, when in closed position, prevent flow of air from the attic into the room or living space of a building or house.

FIGS. 12 through 21 illustrate a modification of frame structure and shutter assembly particularly for use with a ventilating fan housing and fan construction of larger size, for example, for use with a housing of an inner diameter of about thirty inches or more and a fan of slightly less diameter. In this form of the invention the shutter support frame construction 130 comprises two sections or components 131 and 132, each component being of semiannular or semicircular shape.

The component 131 has a semicircular planar configuration 133 and the other component 132 has a semicircular planar configuration 133'. The component 131 has a central support means, section or portion 135 and the component 132 has a central support means, section or portion 135'.

Figure 13:
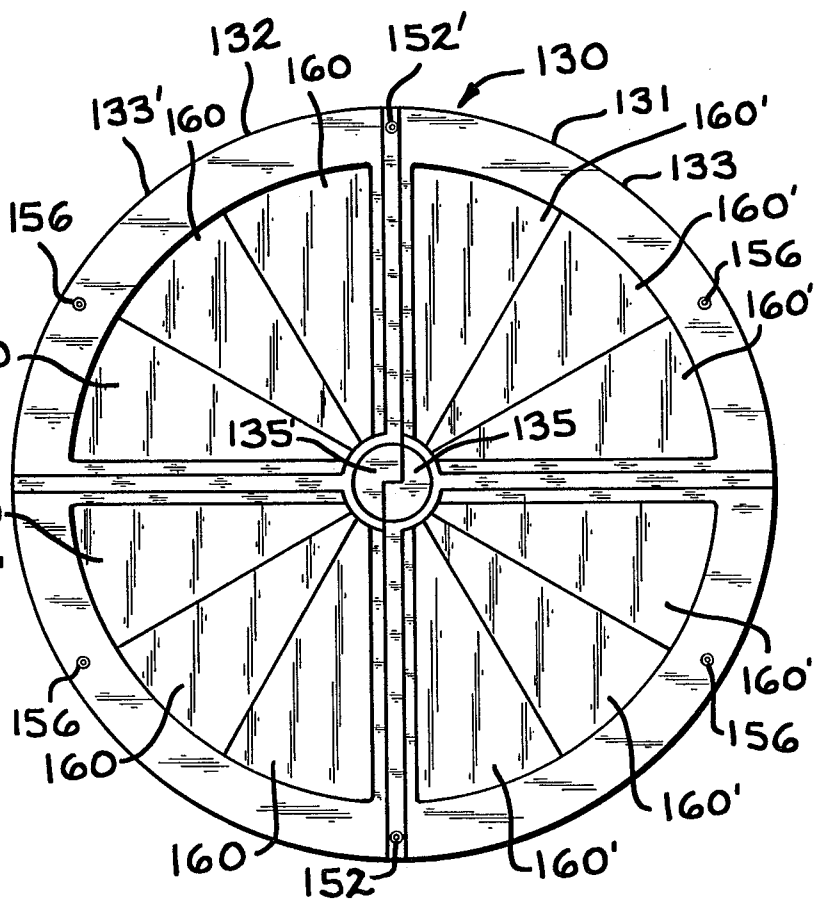
FIG. 13 is a bottom plan view similar to FIG. 12 showing the two semicircular or semiannular components in assembled relation with the shutters.
Figure 12:
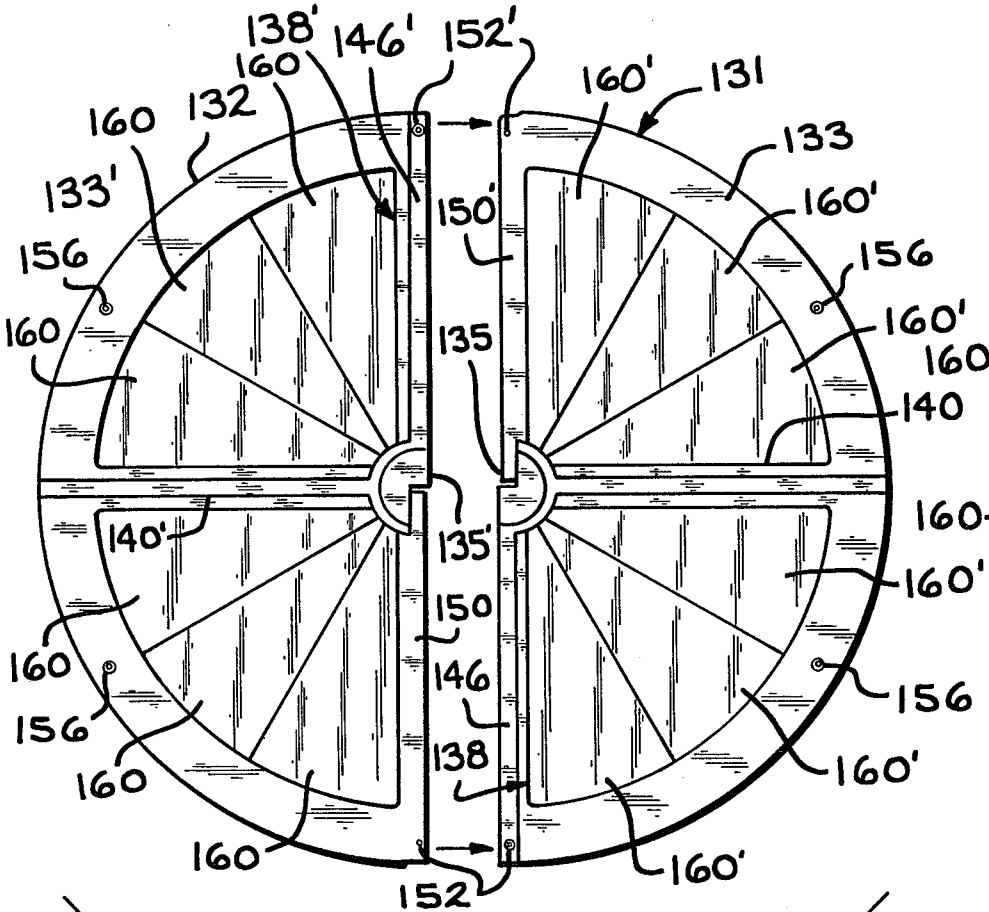
FIG. 12 is an expanded bottom plan view of a modification of frame and shutter construction illustrating an annular or circular frame comprising two semicircular or semiannular components or configurations and a plurality of shutters supported by the semicircular or semiannular frame components.
Figure 14:
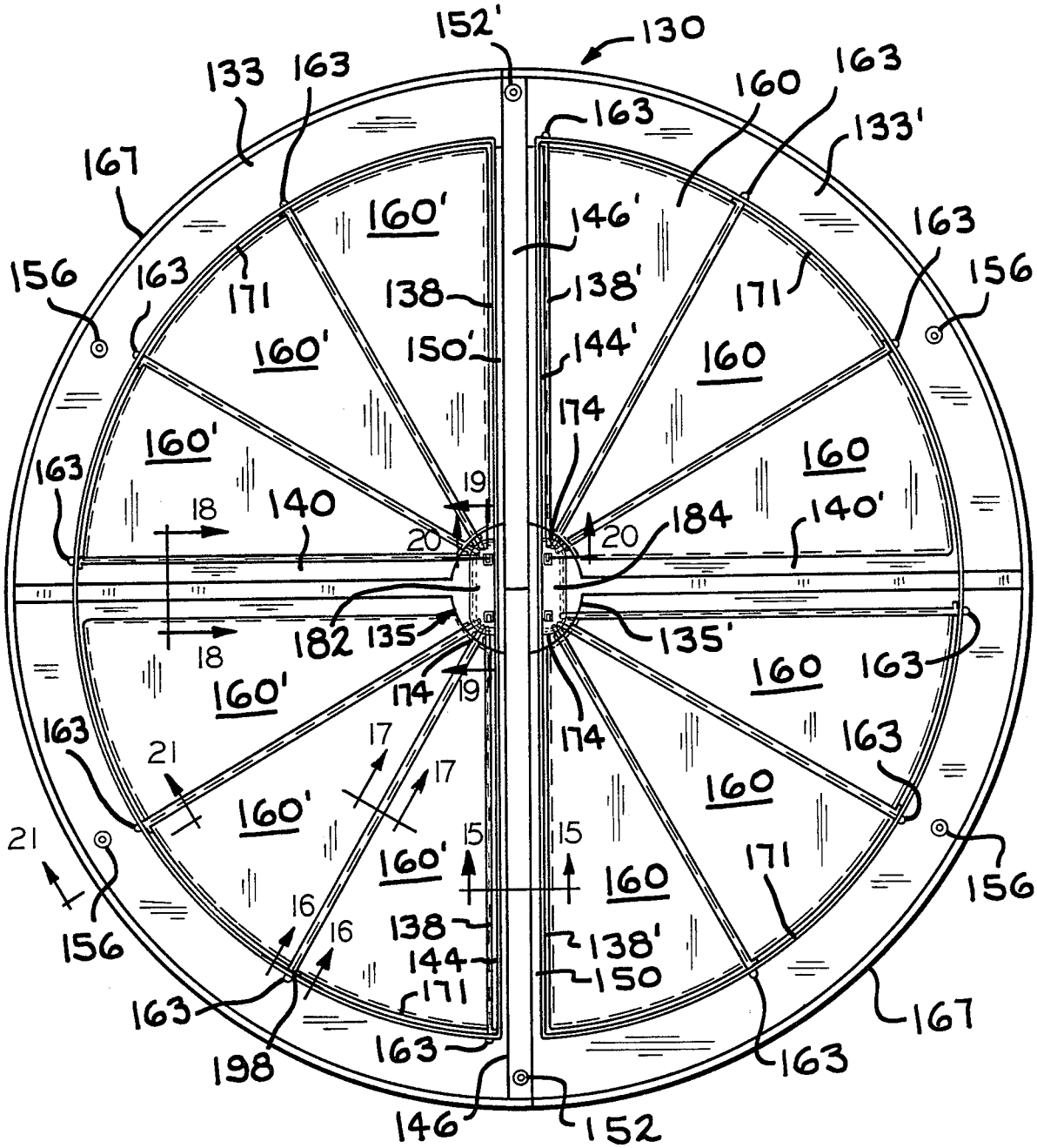
FIG. 14 is a top plan view of the frame construction and shutters in assembled relation.

FIG. 12 illustrates each of the frame components 131 and 132 in disassembled relation and FIGS. 13 and 14 illustrate these components in assembled relation.

The end regions of the semicircular configuration 133 of the component 131 are joined with the central support means or section 135 by a bar or member 138 and the end regions of the semicircular configuration 133'of the component 132 are joined with the central support means or section 135' by a bar or member 138'. The semicircular configuration 133 of the component 131 is also joined by a bar 140 with the central support means or section 135 and the semicircular configuration 133' of the component 132 is joined with the central support means, section or portion 135' by a bar or member 140'.

Figure 18:
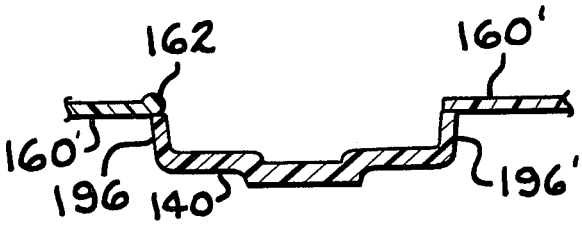
FIG. 18 is an enlarged fragmentary sectional view taken substantially on the line 18—18 of FIG. 14.

FIG. 18 illustrates the cross sectional shape of the bar 140, and the cross sectional shape of the bar 140' is of the same configuration. The component 131 comprising the semicircular configuration 133, the bar or member 138, and the bar or member 140 are formed and joined integrally by molding and preferably fashioned of resinous plastic material such as high impact polystyrene.

The component 132 comprising the semicircular configuration 133', the bar or member 138', and the bar or member 140: are joined integrally by molding and preferably fashioned of resinous plastic material such as high impact polystyrene. The bars 138 and 138' are formed with regions which are interlocked for securing the two components in assembled relation as shown in FIGS. 13 and 14. Reference is made to the sectional view, FIG. 15, which shows an arrangement for interlocking and securing the components 131 and 132 together in assembled relation as shown in FIG. 14.

Figure 15:
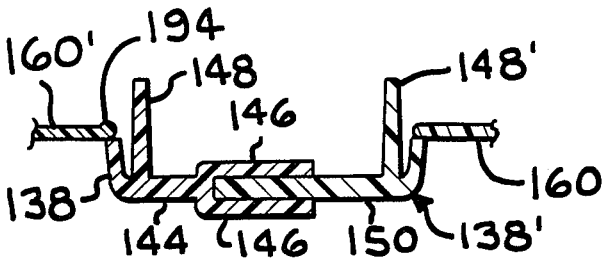
FIG. 15 is an enlarged fragmentary sectional view taken substantially on the line 15—15 of FIG. 14.

In FIG. 15 the portion 144 of the bar or member 138 is provided with two parallel spaced portions or furcations 146 extending from the circular configuration 133 to the central support section 135. The portion 144 has a reinforcing ridge 148 to impart rigidity to the bar or member 138.

The adjacent portion of the bar 138' below the central section 135 is provided with a portion 150 which extends between the furcations 146 as shown in FIG. 15. The furcations 146 overlapping the portion 150 in FIG. 14 are provided at their lower ends with registering openings 152 which receive a screw (not shown) for securing the lower ends of the semicircular configurations 133 and 133' together.

If a joist is in alignment with the furcations 146 the screw in the openings 152 will be threaded into the joist to support the frame 130 from the joist. The furcations 146 on the portion 138 below the center of the assembly terminate just below the central support means 135'. As shown in FIG. 15 the portion 138' is provided with a reinforcing ridge 148'.

It should be noted in FIGS. 12 and 14 that the portions of the upper half of the bar or member 138' are reciprocal or in reverse position to the same portions in the lower half below the central support means 135'. Thus in the upper half of the bar 138 the portion 150' is between the furcations 146', one of which is shown in FIG. 14, and the portion 144' in FIG. 14 is between the furcations 146'.

The portion 144' and the furcations 146' in assembly have registering openings 152' to receive a screw (not shown) for holding the upper portions of the semicircular configurations 133 and 133' in assembled relation. If a joist is above the bar 138, the screw in the opening 152 may be threaded into the joist as support means for the support frame 130.

The semicircular frame portions 133 and 133' have openings 156 which register with openings in the ceiling and are adapted to receive screws threaded into nuts or clips (not shown) above the ceiling as added means for securing the frame structure 130 to the ceiling.

The support frame 130 and the central support means 135 and 135' are adapted to support a plurality of shutters. It will be noted from FIGS. 12, 13 and 14 that in the embodiment illustrated there are twelve shutters. The shutters are in two groups of six shutters in each group. The shutters in the right-hand group in FIG. 14 are designated 160 and the shutters in the left-hand group are designated 160' Each of the shutters is preferably molded of resinous plastic material such as high impact polystyrene.

Figure 21:
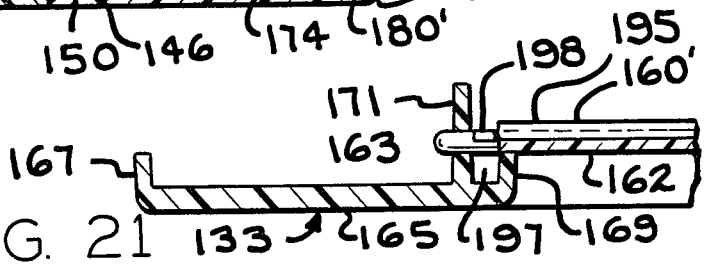
FIG. 21 is an enlarged fragmentary sectional view taken substantially on the line 21—21 of FIG. 14.

Each of the shutters 160 and 160' is provided along one edge with a ridge 162 of circular cross section which terminates at its end regions in cylindrical pivot pins, pintles or shaft portions 163 and 174. As shown in FIG. 21 each of the circular portions 133 and 133' of the components 131 and 132 is provided with a horizontal flat or planar circular portion 165 having an outer upward circular flange 167 and an inner circular flange 169. The outer upstanding flange 167 engages the ceiling just outside of the hole that is cut in the ceiling to accommodate pivotal movement of the shutters.

Spaced outwardly of the inner flange 169 is an upstanding circular portion or band 171. The band 171 of each of the circular configurations 133 and 133' is provided with openings receiving the cylindrical pins, pintles or shaft portions 163 thereby providing a pivotal support for the outer ends of each of the shutters on the semicircular frame configurations 133 and 133'.

Figure 20:
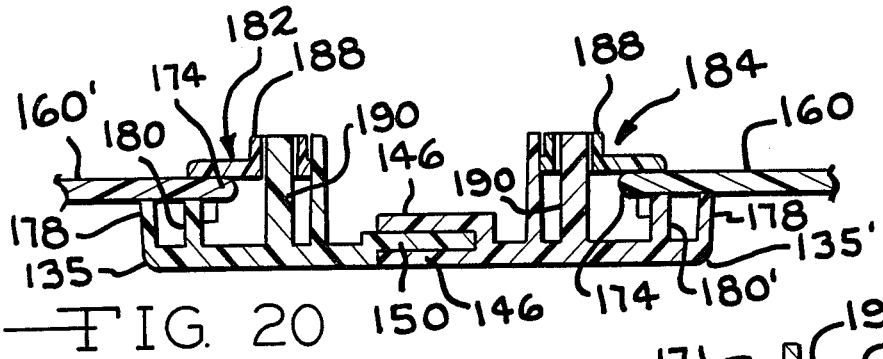
FIG. 20 is an enlarged fragmentary sectional view taken substantially on the line 20—20 of FIG. 14.

Means is provided at the central support means 135 and 135' for pivotally supporting pivot pins, pintles or shaft portions 174 provided on the inner ends of the shutters 160 and 160'. Reference is made to FIG. 20 which illustrates the mounting arrangement supporting the shutter pins 174 and the retainer means for maintaining the pins 174 in slots in central portions 135 and 135'. The retainer means associated with the central portions 135 and 135' are substantially the same except that the means 135 has a portion 150 extending between the furcations 146.

Figure 19:
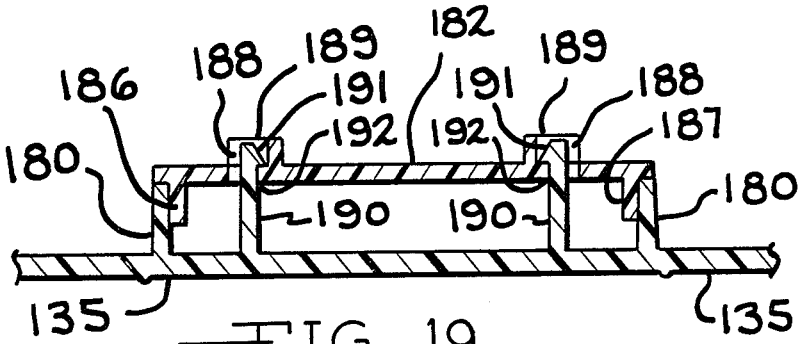
FIG. 19 is an enlarged fragmentary sectional view taken substantially on the line 19—19 of FIG. 14.

FIG. 19 illustrates one of the retainer means for retaining the pivot pins, pintles, or shafts 174 in slots in the central support means 135 and 135'. In further reference to FIG. 20 the means 135 and 135' have upwardly extending flanges 178 which are engaged by the pins 174 of the shutters 160 and 160'.

The central support means 135 has an upwardly extending flange 180 and the central support means 135' has an upwardly extending flange 180'. The upper portion of the flanges 180 and 180' are provided with slots which receive the pivot pins 174 on the inner ends of the shutters.

A retaining means or member 182 is for retaining the pins or pintles 174 on the inner ends of the shutters 160' in slots in the flange 180, and the retainer means 184 is for retaining the pins 174 of the shutters 160 in the slots in the portion 180'.

As shown in FIG. 19 the retainer means 182 has two depending portions 186 and 187 which fit inside the upwardly extending projections 180 on the support section 135. The horizontal portion of the retaining means 182 is fashioned with square projections 188 having slots or openings 189. Extending upwardly from the horizontal portion 135 in FIGURE 19 are two projections 190, the upper end of each of the projections 190 having a laterally extending tooth or lug 191 which engages and hooks over a portion 192 projecting into the openings 189.

As the upwardly extending portions 190, shown in both FIGS. 19 and 20, are of resinous plastic material they have a certain amount of flexibility so that normally when the retainer 182 is snapped into pin retaining engagement, the members 190 are flexed so that the teeth 191 hook over the projecting portions 192 of the retaining means or retainer 182.

The retainer 184 is of the same construction as the retainer 182 and retains the pins 174 of the shutters 160 in the grooves in the flange 180'. In this manner the inner pins or pintles 174 of the shutters are pivotally supported on the central support means or structures 135 and 135'.

Figure 17:
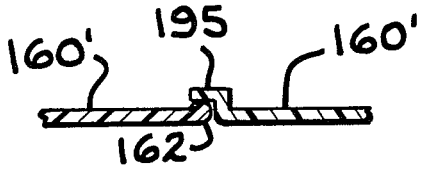
FIG. 17 is an enlarged fragmentary sectional view taken substantially on the line 17—17 of FIG. 14.

FIG. 17 illustrates the overlapping relationship of a shutter with an adjacent shutter. Each of the shutters has a ridge 162, and an edge of the adjacent shutter is provided with a raised portion 195 shown in FIG. 17 adapted when the shutters are in closed position to overlap the adjacent shutter in the manner illustrated in FIG. 17.

FIG. 18 illustrates the ridge 162 of a shutter 160' in close position to an upwardly extending portion 196 of the member 140. Another portion 196' on the member 140 is engaged by a shutter 160' in the manner shown in FIG. 18 when the shutters are in closed position.

Figure 16:
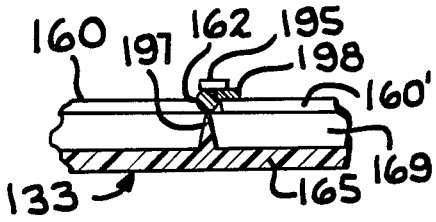
FIG. 16 is an enlarged fragmentary sectional view taken substantially on the line 16—16 of FIG. 14.

Means is provided for limiting the open position of each of the shutters. As shown in FIGS. 16 and 21, the horizontal portion 165 of each circular configuration 133 and 133' is fashioned adjacent the outer end of each shutter with an upwardly extending projection 197, and the edge of the shutter is provided with a projection 198 which extends laterally of each of the shutters. It will be noted from FIG. 16 that when a shutter is rotated in a clockwise direction from closed to open position, each lateral projection 198 will engage a stationary projection 197 to limit the open position of each of the shutters. This feature is important in that it enables the shutters to readily move to closed position by force of gravity when air flow ceases through the shutter assembly.

Through the provision of two components 131 and 132, each group of shutters may be preassembled with a component and the components with the shutters assembled therewith may be brought together as shown in FIGS. 13 and 14 during installation of the assemblage in the hole in the ceiling.

Through the utilization of a large number of shutters, the shutters may be of smaller size and hence of lighter weight so that the air stream created by the ventilating fan will readily open all of the shutters.

It is apparent that, within the scope of the invention, modifications and different arrangements may be made other than as herein disclosed, and the present disclosure is illustrative merely, the invention comprehending all variations thereof.

We claim:

1. A shutter apparatus for istallation in an opening in the ceiling below the attic space of a house for controlling air flow from inside the house to the exterior of the house comprising, shutter support means including a frame structure of circular configuration mounted in said opening, a plurality of sector-shaped shutters, means pivotally mounting each of the shutters on saids frame structure, said shutters in closed position obstructing the open area in said ceiling and being substantially in the plane of said ceiling, said shutter support frame structure being of molded resinous plastic material.

2. Apparatus according to claim 1 wherein the shutters are of molded resinous plstic material.

3. Apparatus according to claim 1 wherein the frame structure supporsts eight shutters

4. Apparatus according to claim 1 wherein the frame structure supports twelve shutters.

5. A shutter apparatus for installation in an opening in the ceiling below the attic space of a house for controlling air flow from inside the house to the exterior of the house, shutter support means including a frame structure of circular configuration and having a central support means connected with the circular configuration, said circular configuration defining an open area for mating with said ceiling opening, as plurality of sector-shaped shutters, means including pivot pin portions on the inner and outer ends of the shutters pivotally mounting each of the shutters on the circular configuration and the central support means, said shutters in closed position obstructing the open area in said ceiling and being substantially in the plane of said ceiling, said shutter support frame structure being of molded resinous plastic material, and said shutters being of molded resinous plastic material.

6. Apparatus according to claim 5 wherein the resinous plastic material is high impact polystyrene.

7. Apparatus according to claim 5 wherein openings in the circular frame structure receive the pivot pin portions on the outer ends of the shutters, the central support means of the frame structure having slots receiving the pivot pin portions on the inner ends of the shutters, and means engaging the central support means of the frame structure for retaining the pivot pin portions on the inner ends of the shutters in the slots.

8. Apparatus according to claim 5 wherein the frame structure of the shutter support means comprises two semicircular components, the shutters being in two groups, each of said semicircular components supporting a group of the shutters, a first member joining the end regions of one semicircular component, a second member joining the end regions of the other semicircular component, means securing the semicircular components together, portions of the central support means being integrally formed with each of the first and second members, each of the circular configurations of the semicircular components having openings receiving the outer pivot pin portions of the shutters, each portion of the central support means having slots receiving the inner pin portions of a group of the shutters, and means engageable with the central support means for retaining the inner pivot pins of the shutters in the slots.

9. Apparatus according to claim 5 wherein the frame structure of the shutter support means comprises two semicircular components, the shutters being in two groups, each of said semicircular components supporting a group of the shutters, a first member joining the end regions of one semicircular component, a second member joining the end regions of the other semicircular component, means securing the semicircular components together, portions of the central support means being integrally formed with each of the first and second members, each of the circular configurations of the semicircular components having openings receiving the outer pivot pin portions of the shutters, each portion of the central support means having slots receiving the inner pin portions of a group of the shutters, a first retainer means engageable with one portion of the support means for retaining the inner pivot pins of one group of shutters in slots in said one portion of the central support means, and a second retainer means engageable with the other portion for retaining the inner pivot pins of the other group of shutters in the slots in said other portion.

10. A shutter apparatus for installation in an opeing in the ceiling below the attic space of a house for controlling air flow from inside the house to the exterior of the house, a frame structure, said frame structure comprising two semicircular components, two groups of sector-shaped shutters, each of said semicircular components supporting a group of the shutters, a first member joining the end regions of one semicircular component, a second member joining the end regions of the other semicircular component, means securing the semicircular components together for forming a circular component for mating with said ceiling opening, each of said members having a central shutter support means, the shutters having inner end and outer end pivot pins, the outer end pivot pins of the shutters extending into openings in the circular region of the semicircular components, the inner end pivot pins of one group of shutters extending into slots in the central support means of the member of one of said components, the inner pivot pins of the other group of shutters extending into slots in te central support means of the member of the other of said components, and means for retaining the pins in the slots, said shutters when in the closed position being substantially in the plane of said ceiling.

11. Apparatus according to claim 10 wherein the means for retaining pins in the slots comprise a first retaining engageable with the central support means of the member of the first component for retaining the inner pins of one group of shutters in the slots, and a second retainer engageable with the central support means of the member of the second component for retaining the inner pins of the other group of shutters in the slots.

12. A shutter apparatus for installation in an opening in the ceiling below the attic space of a house for controlling air flow from inside the house to the exterior of the house comprising, shutter supprt means including a frame structure of circular portion and a central support means connected with the circular frame portion, said circular frame portion defining an open area for mating with said ceiling oepning, a plurality of circular sector-shaped shutters, means on each of said shutters pivotally mounting the shutters on the circular portion and the central support means, said shuttes in closed position obstructing the open area, said shutters being opened by flow of air through the open area, said shutters being moved to closed position by force of gravity when air flow ceases through the open area, said shutters being substantially in the plane of said ceiling when in said closed position, and means for limiting the open position for each of the shutters.

13. Apparatus according to claim 12 wherein the support frame is of molded resinous plastic material.

14. Apparatus according to claim 12 wherein the shutters are of molded resinous plastic material.

15. Apparatus according to claim 12 wherein the circular portion of the frame and the central support means are formed with slots, the pivotally mounted shutters having pivot pin portions received in the slots, and means engaging the circular frame portion and central support means for retaining the pivot pin portions in the slots.

16. Apparatus according to claim 12 wherein the circular portion of the frame and the central support means are formed with slots, the pivotally mounted shutters having pivot pin portions received in the slots, and retaining clips engageable with the circular frame portion and central portion for maintaining the pivot pin portions in the slots.

17. Apparatus according to claim 12 wherein the circular frame is connected with the central support means by a bar, said circular frame, said bar and said central supports means being integrally formed of molded resinous plastic material.

18. A shutter apparatus for installation in an opening in a ceiling of room for controlling upward air flow through the opening resulting from rotation of a ventilating fan disposed above the opening, said shutter apparatus including a frame having a circular portion for mounting in the opening in the ceiling, the frame including a central support means connected with the circular portion, said circular portion having a flange for engagement with the lower surface of the ceiling, a plurality of sector-shaped shutters, pivot means on each of said shutters for pivotally mounting the shutters on the circular portion and the central support means, said shutters being opened by upward flow of air through the ceiling opening, said shutters being moved to closed position by force of gravity when the fan is not operating, said shutters being substantially in the plane of said ceiling when in said closed position.

19. A ventilating apparatus for a living area of a building comprising a fan housing for installation above an opening the ceiling of the living area within the attic thereof, an air circulating fan in the housing rotatable in a direction moving air upwardly through the housing, an electric motor for rotating the fan, means secured to the housing for mounting the fan operating motor, a frame having a circular portion and a central support means, said frame being disposed below the fan housing, a plurality of movable shutters, each of said movable shutters being pivotally mounted upon the circular portion of the frame and the central support means, said shutters in closed position being substantially in a common plane with said ceiling when the fan is not operating, said shutters being actuated to open position by upward flow of air through the housing when the fan is operating, said shutters being actuated to closed position by force of gravity when the fan is not operating.

20. A method of ventilating a living area of a building having a ceiling provided with an opening between the living area and a vented attic space above the ceiling, establishing an air stream moving upwardly through the opening in the ceiling by an assemblage of shutters pivotally mounted on a frame in the ceiling opening, the shutters being of a circular sector shape and when in a position closing the opening in the ceiling are disposed in substantially a common horizontal plane with said ceiling, the shutters being actuated to open position by upward flow of air through the opening in the ceiling, the shutters being actuated to closed position by force of gravity when air flow ceases through the opening.

* * * * *